US009440756B2

(12) United States Patent
Michels

(10) Patent No.: US 9,440,756 B2
(45) Date of Patent: Sep. 13, 2016

(54) METHOD OF AND APPARATUS FOR WRAPPING A STACK OF OBJECTS WITH A FILM

(75) Inventor: Frank Rolf Michels, Kleve (DE)

(73) Assignee: MSK-VERPACKUNGS-SYSTEME GMBH, Kleve (DE)

( * ) Notice: Subject to any disclaimer, the term of this patent is extended or adjusted under 35 U.S.C. 154(b) by 1226 days.

(21) Appl. No.: 12/974,294

(22) Filed: Dec. 21, 2010

(65) Prior Publication Data

US 2011/0146210 A1 Jun. 23, 2011

(30) Foreign Application Priority Data

Dec. 21, 2009 (EP) ..... 09015789

(51) Int. Cl.

| | |
|---|---|
| ***B65B 11/00*** | (2006.01) |
| ***B65B 9/13*** | (2006.01) |
| ***B65B 41/16*** | (2006.01) |
| ***B65B 59/04*** | (2006.01) |

(52) U.S. Cl.

CPC ..... *B65B 9/135* (2013.01); *B65B 41/16* (2013.01); *B65B 59/04* (2013.01)

(58) Field of Classification Search

CPC ..... B65B 9/10; B65B 9/13; B65B 9/135; B65B 59/04; B65B 53/00; B65B 43/04; B65B 11/00; B65B 11/02; B65B 41/16; B65B 59/02

USPC ..... 53/203, 397, 399, 441, 461, 580, 582, 53/590–591, 556, 459, 261, 393, 218, 53/389.1; 269/228; 242/552, 410

See application file for complete search history.

(56) References Cited

U.S. PATENT DOCUMENTS

| | | | | |
|---|---|---|---|---|
| 3,621,638 | A * | 11/1971 | Grocke | 53/386.1 |
| 3,778,960 | A * | 12/1973 | Christensen | B65B 9/135 53/386.1 |
| 3,823,527 | A * | 7/1974 | Burn | 53/567 |
| 3,831,512 | A * | 8/1974 | Johnson | 100/26 |
| 3,897,674 | A * | 8/1975 | Higgins | 53/66 |
| 4,507,904 | A * | 4/1985 | Treiber | 53/203 |

(Continued)

FOREIGN PATENT DOCUMENTS

| | | | | |
|---|---|---|---|---|
| DE | 2706955 A1 * | 8/1978 | ..... | B65B 9/135 |
| DE | 3540095 A1 * | 5/1986 | ..... | B65B 9/135 |

(Continued)

OTHER PUBLICATIONS

Menezes, A et al, "Hash Functions and Data Integrity" *Handbook of Applied Cryptography* Oct. 1, 1996 p. 321-383 http:// www.cacr.math.uwaterloo.ca/hac/.

(Continued)

*Primary Examiner* — Gloria R Weeks
*Assistant Examiner* — Justin Citrin
(74) *Attorney, Agent, or Firm* — Andrew Wilford

(57) ABSTRACT

An apparatus for wrapping a stack of objects with a film has a film supply holding the film and a support including only two vertical masts adjacent the film supply and juxtaposed with the stack to be wrapped. A pull-down device is shiftable vertically along the two masts next to the stack. A film-feed head is also shiftable vertically along the two masts. The film extends from the supply through the film-feed head to the pull-down device. A film-storing means or looper is provided in the film-feed head for storing a variable length of the film in the head.

14 Claims, 9 Drawing Sheets

(56) References Cited

U.S. PATENT DOCUMENTS

| | | | | |
|---|---|---|---|---|
| 4,573,305 | A * | 3/1986 | Wildmoser | 53/466 |
| 4,745,726 | A * | 5/1988 | Rosenthal et al. | 53/77 |
| 4,934,123 | A * | 6/1990 | Salzsauler | 53/399 |
| 5,155,970 | A * | 10/1992 | Moore | 53/399 |
| 5,195,301 | A * | 3/1993 | Martin-Cocher et al. | 53/441 |
| 6,032,439 | A * | 3/2000 | Birkenfeld et al. | 53/441 |
| 6,041,575 | A * | 3/2000 | Vonderhorst et al. | 53/415 |
| 6,206,366 | B1 * | 3/2001 | Schmid | 271/217 |
| 6,318,048 | B1 * | 11/2001 | Sambuca, Jr. | 53/136.4 |
| 6,845,600 | B2 * | 1/2005 | Hannen | C04B 38/00 53/441 |
| 7,210,278 | B2 * | 5/2007 | Chiu Chen | 53/64 |
| 7,325,368 | B2 * | 2/2008 | Miyaoka et al. | 53/64 |
| 2007/0018030 | A1 * | 1/2007 | Bradshaw | B65H 19/102 242/552 |
| 2009/0272080 | A1 | 11/2009 | Lachenmeier | |

FOREIGN PATENT DOCUMENTS

| | | | |
|---|---|---|---|
| DE | 9006438 | U1 | 10/1990 |
| DE | 60024523 | T2 | 8/2006 |

OTHER PUBLICATIONS

Blazik, J et al "Long-term trusted preservation service using . . . " *Computer Standards and Interfaces* Feb. 2, 2007 vol. 29, No. 3 Elsevier Sequoia, Lausanne, CH.

* cited by examiner

METHOD OF AND APPARATUS FOR WRAPPING A STACK OF OBJECTS WITH A FILM

FIELD OF THE INVENTION

The present invention relates to wrapping a stack of objects with film. More particularly this invention concerns a production-type packaging machine for palletized goods and a method of wrapping a stack of goods.

BACKGROUND OF THE INVENTION

A standard apparatus for wrapping stack of objects with a film has at least one film-supply means for the film, a head for feeding the film, and a pull-down device for pulling the film over the stack of objects. The film is fed from the film-supply means to the film-feed head and the film-feed head can be moved in the pull-down direction of the film and opposite to the pull-down direction of the film. Film in the context of the invention means a plastic film in particular, and preferably an elastic plastic film. The stack of objects to be wrapped normally comprises stacked products. However, the stack of objects can also be products from the white goods area, such as refrigerators or the like. It is advantageous for the stack of objects to be supported on a pallet.

An apparatus of the type described above is known from WO 2008/031449 A1 [US 2009/0272080]. In this known apparatus, the film-feed head can be moved to a lower position for maintenance purposes. The apparatus has four vertical masts between which the film-feed head is carried and on which the film-feed head is supported as it moves. In the process, the film-feed head is transported along the pull-down device that moves vertically up and down. At least two drive motors at the four vertical masts are needed to move the pull-down device. The drive motors must be synchronized in a relatively complicated manner. Based on the design, with four vertical masts, this apparatus is a complex and voluminous system in which transport and installation are relatively expensive. When the film-feed head is moved to a lower maintenance position, the film to be fed is threaded out of the film-feed head, and after returning to an upper operating position the film is threaded back through. This is elaborate and time-intensive. The result is that this known apparatus is characterized by a relatively high degree of complexity with regard to its transport, installation and operation/maintenance.

OBJECTS OF THE INVENTION

It is therefore an object of the present invention to provide an improved apparatus for wrapping a stack of objects with a film.

Another object is the provision of such an improved apparatus for wrapping a stack of objects with a film that overcomes the above-given disadvantages, in particular in which transport, installation, and operation/maintenance are less expensive, less complex, and less time-consuming.

A further object is to provide an improved method of operating such an apparatus.

SUMMARY OF THE INVENTION

An apparatus for wrapping a stack of objects with a film has according to the invention a film supply holding the film and a support including only two vertical masts adjacent the film supply and juxtaposed with the stack to be wrapped. A pull-down device is shiftable vertically along the two masts next to the stack. A film-feed head is also shiftable vertically along the two masts. The film extends from the supply through the film-feed head to the pull-down device. A film-storing means or looper is provided in the film-feed head for storing a variable length of the film in the head.

According to the invention, the film-feed head is moved along only two vertical masts that are parallel to one another. The two vertical masts are advantageously connected with one another at their upper ends and at their lower ends thereof by at least one stabilizing bracket.

The invention proposes that the film-storing means is provided for taking up the film while the film-feed head moves in the pull-down direction and for letting out film while the film-feed head moves opposite to the pull-down direction. A preferred embodiment of the film-storing means for the apparatus according to the invention is explained in more detail below.

According to an especially preferred embodiment of the invention, the film is able to be fed as a tube of film. It is recommended that the tube of film be designed as side-gusseted tubing. This advantageously provides the tube of film with a fold on each side next to two film layers one on top of the other. A preferred embodiment is characterized in that a tube of film, i.e. a side-gusseted tube, is pulled over the stack of objects as a film hood. Thereafter, the tube of film is then preferably fused in a known fashion.

According to a first preferred embodiment, the apparatus according to the invention can be designed as a shrinking unit for shrinking the film onto a stack of objects. It is then advantageous for the apparatus to comprise a shrink-frame that can be moved, preferably similar to the pull-down device and similar to the film-feed head, in the pull-down direction of the film and opposite to the pull-down direction of the film. The shrink-frame is electrically heated, for example, for shrinking a film. However, according to a second preferred embodiment, the apparatus according to the invention can also be a hood-stretcher. In this case, the invention proposes that the apparatus comprises a transverse stretcher and preferably a gathering device for gathering the film. In such an apparatus, the pull-down device can simultaneously be used as the transverse stretcher.

The invention proposes that the film-supply means is a film wound into a film coil or a tube of film wound into a film coil. The film or tube of film is fed from the film-supply means to the film-feed head by the film-storing means. The invention further proposes that the film is thus fed or held in the film-feed head. The one film-supply means and the one film coil are advantageously in the lower area of the apparatus according to the invention. Preferably the one film-supply means and the one film coil to be within the lower half of the vertical masts relative to the height thereof.

An especially preferred embodiment of the invention is characterized in that the film-feed head comprises two parallel side elements or walls that are each associated with one of the two vertical masts and is guided on an outer face of the respective mast when the film-feed head is moved. What is meant by the outer face of a vertical mast is its face that is directed away from the other vertical mast. It is advantageous for the vertical masts to be rectangular in cross section and for them to comprise an outer, an inner, a front, and a back face. The inner face of a vertical mast is the side of the mast that is directed toward the other vertical mast. The front face of a vertical mast is the side of the vertical mast that is directed toward the stack of objects or the film-feed head. The invention proposes that the two side elements or side walls are parallel to one another. The invention further proposes that the two side elements or side walls are to the side of or perpendicular, or substantially perpendicular, to the vertical masts.

According to a very preferred embodiment of the invention, each side element or each side wall is supported against the outer face of its respective vertical mast by at least one support element, preferably by at least one support roll. It is preferable for each side wall of the film-feed head to comprise a support roller for supporting the respective side wall at the outer face of the respective vertical mast. It is thus advantageous for the support roller to be partially embedded into the respective side wall.

A very recommended embodiment is characterized in that each side element or each side wall of the film-feed head is supported at the front face of the respective vertical mast by at least two support elements, in particular by at least two support rollers. It is advantageous for each side element or each side wall to be supported at the front face of the respective vertical mast by only two support rollers. Preferably, each side element or each side wall of the film-feed head is supported at the back face of the respective vertical mast by at least two support elements, in particular by at least two support rollers. It is advantageous for each side element or each side wall to comprise only two support rollers for supporting the side element or side wall of the back face of the respective vertical mast.

The invention proposes that the spacing from an uppermost support roller supported on the front face of a vertical mast to the lowermost support roller supported on the back face of the respective vertical mast is at least 30%, preferably at least 35%, of a spacing between a center of gravity of the film-feed head and a plane formed or defined by the front faces of the vertical masts. It is recommended that this arrangement of the two support rollers be implemented at both vertical masts. The center of gravity relates to the mass of the film-feed head and to the mass of the parts of the film-feed head. The spacing of the two support rollers is measured from the lower edge of the uppermost support roller to the upper edge of the lowermost support roll. The invention proposes that the height of the side wall of the film-feed head is matched to the spacing between the uppermost and the lowermost support roll.

It is recommended that the spacing of an uppermost support roller supported at the back face of a vertical mast to the lowermost support roller supported at the front face of the vertical mast is at least 35%, preferably at least 45% of the spacing between the center of gravity of the film-feed head and the plane formed or defined by the front faces of the vertical masts. The spacing of the two support rollers is measured from the lower edge of the uppermost support roller to the upper edge of the lowermost support roll. Preferably, the arrangement of the two support rollers described above is implemented at both vertical masts.

A particularly recommended embodiment of the invention is characterized in that the parts of the film-feed head are all outside an intermediate space between the two vertical masts. Thus, according to this embodiment there are no parts of the film-feed head between the two vertical masts. It is preferable for only the film or films to pass between the two vertical masts and be fed to the film-feed head. This embodiment makes it possible for the film-feed head to be easily fitted down from above on the vertical masts or on the vertical masts attached to a stabilizing bracket when the apparatus is assembled.

A very preferred embodiment of the invention is characterized in that the pull-down device is perpendicular or substantially perpendicular to the two vertical masts, in particular when the film is pulled over the stack of objects, and that the pull-down device can be pivoted relative to the two vertical masts about a horizontal pivot axis. It is preferable for the pull-down device to comprise two arms that are parallel or substantially parallel to one another, the arms being perpendicular or substantially perpendicular to the two vertical masts, in particular when the film is pulled over the stack of objects, the arms also being pivotal relative to the two vertical masts about the horizontal pivot axis. In operating the device according to the invention, the pull-down device and the two arms of the pull-down device are perpendicular or substantially perpendicular to the two vertical masts, or are horizontal. The pull-down device and the arms of the pull-down device can then be pivoted relative to the vertical masts about the horizontal pivot axis, primarily for transporting the apparatus. It is advantageous for the arms to be parallel or substantially parallel to the two vertical masts in this pivoted position. The pivoted state against the vertical masts results in a compact, low-volume system that can be easily transported. The ability of the pull-down device to pivot has also shown to be advantageous when the pull-down device runs into an obstacle as it moves vertically downward. When this happens the pull-down device and the arms of the pull-down device are not damaged, but are pivoted upward. The invention proposes that the pull-down device and the arms are only pivotal when a minimum force acting on the pull-down device and on the arms is exceeded. To this end, the pull-down device and the arms are preferably friction-locked against at least one abutment element, and pivoting is only possible when the force acting on the pull-down device and the arms exceeds the retaining force produced by the friction lock.

It has been shown to be advantageous to provide at least one drive for the pull-down device and for the pull-down device to be movable in the pull-down direction of the film and opposite thereto by the drive. An especially preferred embodiment of the invention is characterized in that the film-feed head can also be moved in the pull-down direction of the film and opposite thereto by the drive of the pull-down device. What is recommended is to not equip the film-feed head with its own separate drive. It is preferable for the drive for the pull-down device to be near the base upon which the apparatus according to the invention sits. It is advantageous for the drive or for a drive motor of the pull-down device to be connected to a pull-down carriage of the pull-down device by at least one coupling element, the carriage being moveable in the pull-down direction and opposite thereto relative to the drive. The coupling element is preferred to be a toothed belt.

According to a particularly recommended embodiment of the invention, as the film-feed head moves it is supported on the pull-down device, and the system comprising the film-feed head and the pull-down device is moveable in common in the pull-down direction and opposite thereto. When the system is moved, the pull-down device or the pull-down carriage of the pull-down device carries the film-feed head with it. The invention proposes that the pull-down device is guided and moved by the pull-down carriage on both vertical masts. The invention further proposes that the system comprising the film-feed head and the pull-down device are moved jointly on both vertical masts. It is recommended that the drive or drive motor for the pull-down device or for the system comprising the pull-down device and the film-feed head be near the base of at least one of the two masts. According to a preferred embodiment of the invention, a drive motor for the pull-down device is near the base of one of the two vertical masts. It is advantageous for this drive motor to be connected to the pull-down device or to the pull-down carriage of the pull-down device by a coupling element that extends along at least one of the vertical masts. This drive motor is also connected, preferably by a shaft, to a coupling element that extends along the other vertical mast, the coupling element also being connected to the pull-down device or to the pull-down carriage of the pull-down device.

A recommended embodiment of the invention is characterized in that the film-feed head comprises at least one latch pawl can engage in a latch seat in at least one upper operating position of the film-feed head so that the film-feed head is held up in this upper operating position. Basically, multiple upper operating positions of the film-feed head could also be provided, and thus multiple upper latch seats for the latch pawl. It is advantageous for an upper operating position of the film-feed head to be in the upper area or in the top area of the two vertical masts. Then, the upper latch seats are also in the upper area or at the top of the two vertical masts. The invention proposes that the one or more latch pawls of the film-feed head engage into a lower latch seat in at least one lower maintenance position of the film-feed head so that the film-feed head is held at the level of this lower maintenance position. The invention further proposes that the maintenance position of the film-feed head is located near the lower end of the vertical masts. The latch seats are preferred to be notches made in the masts. It is preferable for the film-feed head to comprise two latch pawls advantageously at opposite side walls of the film-feed head. It is recommended that each of the two latch pawls be assigned to one of the two vertical masts and that advantageously the latch seats for each latch pawl are provided in each of the two vertical masts. It is preferable for two latch seats to be in the upper area or in the top area of the two vertical mass at the same height and to be associated with an upper operating position of the film-feed head. It is recommended that two latch seats are in the lower area or at the base of the two vertical masts at the same height and that these two latch seats are associated with the lower maintenance position of the film-feed head.

A proven embodiment of the invention is characterized in that the one latch pawl of the film-feed head is part of an antidrop device of the film-feed head and that the one latch pawl engages into an antidrop notch when an unbraked downward skid of the film-feed head occurs. Such unbraked downward drop or "free fall" of the film-feed head can occur if, for example, the coupling element between the drive of the pull-down device and the pull-down carriage breaks. It is advantageous to provide a plurality of antidrop notches in at least one of the two vertical masts, distributed along the height thereof. Such antidrop notches can have a shallower depth than the upper latch seats mentioned above for the special positions of the film-feed head since the antidrop notches only serve to catch the latch pawl and the film-feed head in the event of a "free fall." According to a preferred embodiment, the one latch pawl is able to pivot toward an respective vertical mast under the weight of the film-feed head so that the latch pawl can securely engage into a latch seat or an antidrop notch of the mast. It is recommended that the antidrop device comprises at least one damping device for damping any impact occurring when the latch pawl engages into an antidrop notch in particular. It is advantageous in this regard for the latch pawl to be able to move a bit vertically and for the latch pawl to cooperate with a preferably elastic material, in particular with a rubber bumper, to provide damping. Also set forth by the invention is that the pull-down device or the pull-down carriage of the pull-down device be equipped with an antidrop device.

A recommended embodiment of the invention is characterized in that the film-storing means comprises two guide drums for the film and a compensating drum for the film, the spacing from the compensating drum to the guide drums being variable and the amount of film stored in the film-storing means being adjusted by varying this spacing. It is advantageous for both guide drums to be fixed in position and preferably at the same height or approximately at the same height. The invention proposes that the film fed by the film-supply means is redirected by a first guide drum, then fed in a first direction around and redirected by the compensating drum and then again sent back in a second direction to the second guide drum. It is advantageous for the second direction to be opposite to the first direction. By varying or enlarging the spacing, or vertical spacing, of the compensating drum to the guide drums, the stored amount of film can also be increased. The invention proposes that the spacing from the compensating drum to the two guide drums that are located at the same height or approximately at the same height, is equal to half, or approximately half, of the film amount or film length taken up in the storage means.

A special embodiment of the invention is characterized in that a first film-supply means for a first film and a second film-supply means for a second film are provided, the film-feed head being adapted to alternately feed the first film or the second film, a first film-storing means for accepting and storing the first film when the film-feed head is moved being provided between the first film-supply means and the film-feed head and a second film-storing means for accepting and storing the second film when the film-feed head is moved being provided between the second film-supply means and the film-feed head. It is preferable for both films to be fed between the two vertical masts to the film-feed head.

The invention proposes that the first film and the second film are different films that differ particularly with regard to the formats thereof (film dimensions) and/or with regard to the thickness and/or material thereof. According to a preferred embodiment of the invention, the first and the second film are fed as a tube of film, and in particular as a side-gusseted tube. Both film-supply means are advantageously films or film tubes wound into coils. The first and the second film-storing means can comprise the features explained above concerning film-storing means. The film-feed head is preferred to comprise devices for selectively feeding the first film or the second film. The pull-down device is then provided for pulling the first film or the second film.

The invention also relates to a method of operating an apparatus according to the invention where film is conveyed from at least one film-supply means to a film-feed head, the film fed by the film-feed head is pulled over a stack of objects by a pull-down device, whereby to maintain or repair the apparatus the film-feed head is moved in the pull-down direction of the film to a maintenance position and whereby during movement of the film-feed head film is taken up and stored in a film-storing means between the film-supply means and the film-feed head. Preferably, the film-feed head is moved by the drive of the pull-down device, and the invention proposes that the film-feed head does not have a separate drive or drive motor. It is recommended that the film-feed head be supported or carried by the pull-down device or by the pull-down carriage of the pull-down device when the head is moved in the pull-down direction or opposite thereto.

The object of the invention is initially to be able to transport the apparatus according to the invention easily and in a space-saving manner and to be able to install it quickly and easily. The fact that the apparatus according to the invention comprises only two vertical masts for supporting the film-feed head and the pull-down device results in its taking up only a relatively small volume and in its being able to be transported in a space-saving manner. Furthermore, during installation of the apparatus, the film-feed head and the pull-down device can be pulled down onto the two vertical masts in a simple and trouble-free manner. Since the film-feed head is adapted for traveling along the two vertical masts, installation of the film-feed head on the two vertical masts can be accomplished in a very simple manner. Also, guiding along only two vertical masts allows a simplification of the drive for the film-feed head and for the pull-down device, and in particular allows the controls and synchronization of the drive to be simplified. A further object of the invention is to be able to move the film-feed head, with its high weight relative to the pull-down device, on only two vertical masts in a particularly smooth and trouble-free manner. Also, the mobility of the film-feed head requires that maintenance and repair of the apparatus be possible with a relatively low amount of effort and time. The critical system parts are relatively easily accessible in the apparatus according to the invention. In contrast to many other known apparatuses, the amount of expense in connection with access ladders, platforms and the like can be kept relatively low. The apparatus according to the invention is of a relatively simple design. This permits it to be made with relatively low manufacturing costs as well.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
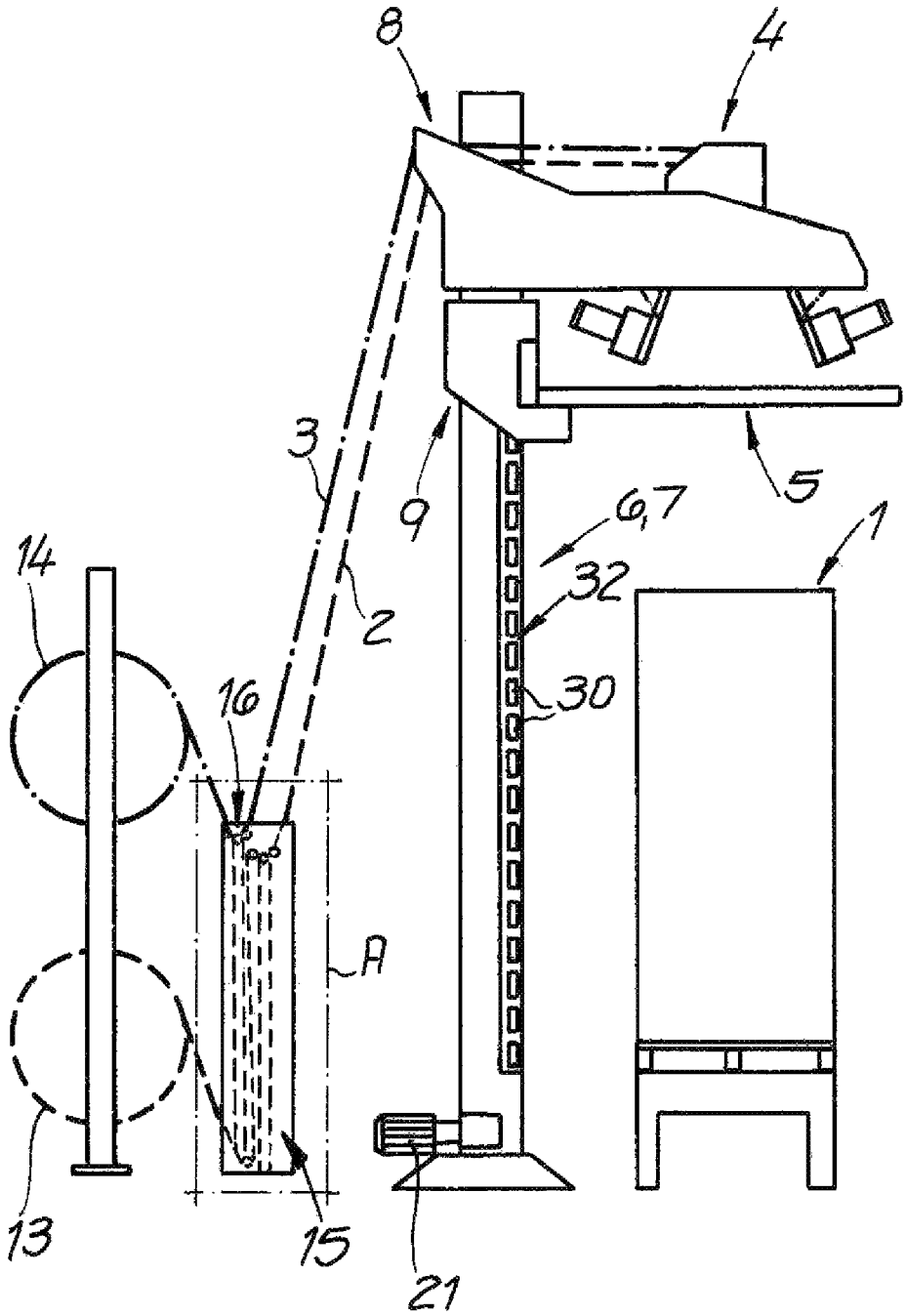
FIG. 1 is a schematic side view of an apparatus according to the invention in a first position.

As seen in FIG. 1 an apparatus for wrapping a stack 1 of objects with a film 2 or 3 is equipped with a pull-down device 5 for pulling the film 2 or 3 over the object stack 1. According to the invention, a film-feed head 4 can be moved downward in the vertical pull-down direction of the films 2 and 3 and upward opposite to the pull-down direction of the films 2 and 3, the motion being along only two vertical masts 6 and 7. To this end, the film-feed head 4 advantageously has a carriage 8 guided on both of the vertical masts 6 and 7 during movement of the film-feed head 4, the guiding being described in more detail below. The invention proposes that the pull-down device 5, which itself has a separate pull-down carriage 9, is also moved along the two vertical masts 6 and 7 and that the pull-down carriage 9 is guided on both of the vertical masts 6 and 7. The pull-down device 5 comprises two arms 35 for pulling down the film 2 or 3 and is underneath the feed head 4.

The apparatus comprises a first film-supply means in the form of a first coil 13 of the first film 2 as well as a second film-supply means in the form of a second coil 14 of the second film 3. The first film 2 can be fed from the first film coil 13 to the film-feed head 4 and the second film 3 can also be fed from the second film coil 14 to the film-feed head 4. To this end, the films 2 and 3 pass between the two vertical masts 6 and 7 to the film-feed head 4. The film-feed head 4 feeds either the first film 2 or the second film 3, but not both at the same time. The first film 2 and the second film 3 may differ, for example with respect to format or thickness.

A first film-storing means or looper 15 (FIGS. 2 and 4) for taking in and storing the first film 2 while the film-feed head 4 is moving is provided between the first film coil 13 and the film-feed head 4. A second film-storing means or looper 16 for taking in and storing the second film 3 while the film-feed head 4 is moving is provided between the second film coil 14 and the film-feed head 4. Both the loopers 15 and 16 are mounted next to each other on the two masts 6 and 7.

Figure 2:
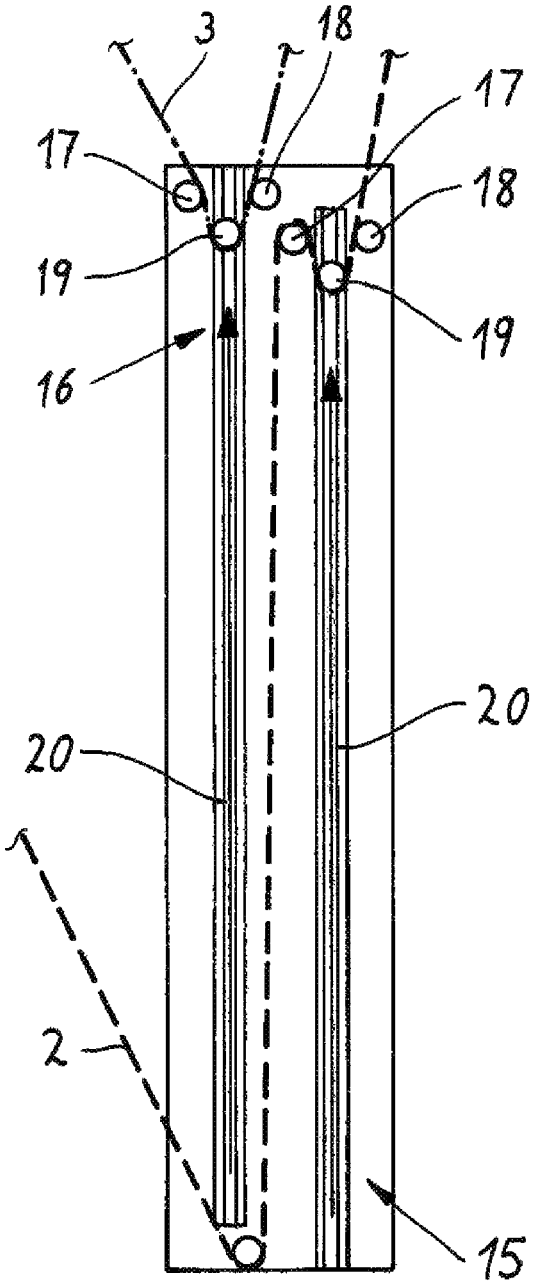
FIG. 2 is a large-scale view of the detail shown at A in FIG. 1.

Each film-storing means 15 and 16 comprises for the respective film 2 or 3 two respective fixed guide drums 17 and 18 preferably located at the same height. Each film-storing means 15 and 16 further comprises a respective compensating drum that moves relative to the respective fixed guide drums 17 and 18. Each of the compensating drums 19 in the embodiment can move or shift vertically along a respective guide 20. In this way, the spacing from each of the compensating drums 19 to the respective guide drums 17 and 18 can be varied, and the amount of film or length of film taken up and stored in the respective film-storing means 15 or 16 can be adjusted by varying this spacing. In the position of FIGS. 1 and 2, the film-feed head 4 is in an upper operating position on the two vertical masts 6 and 7. In this position, the two compensating drums 19 are at a very small spacing from the guide drums 17 and 18 and the amount of film stored in the film-storing means 15 and 16 is small or almost negligible.

Figure 3:
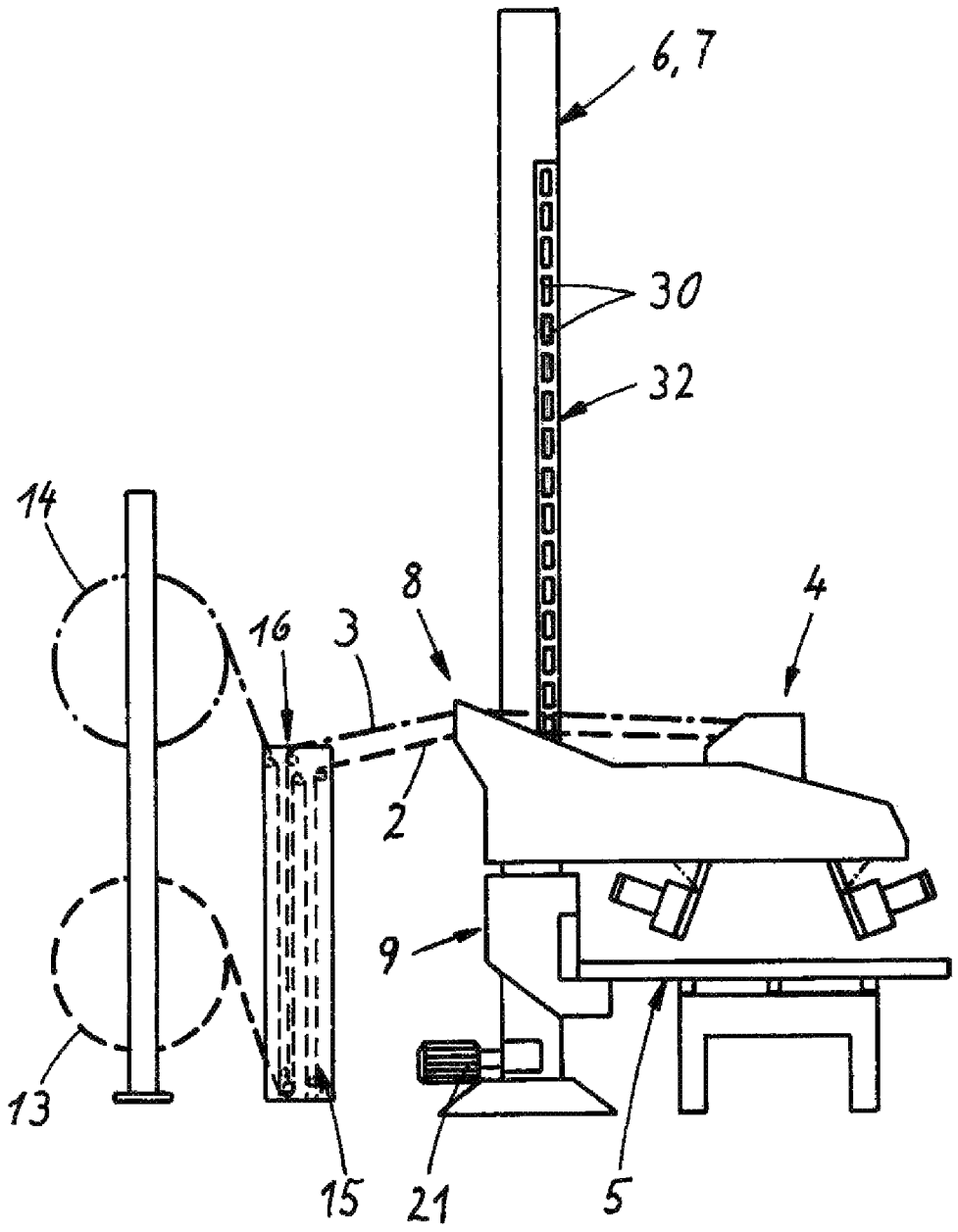
FIG. 3 is the apparatus of FIG. 1 in a second position.
Figure 4:
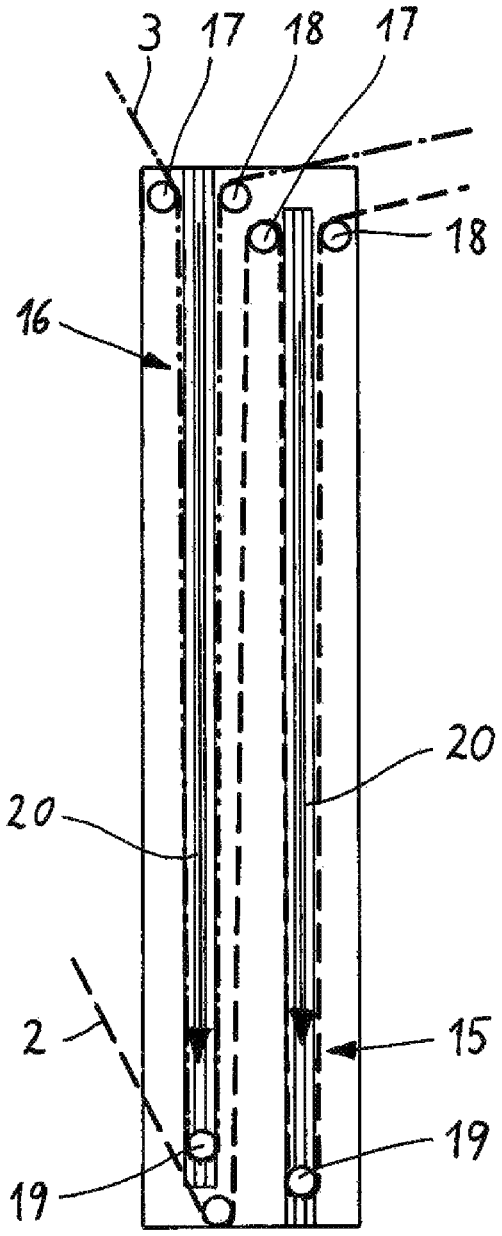
FIG. 4 shows the detail of FIG. 2 in the second position.

In the position according to FIGS. 3 and 4, the film-feed head 4 is located in a lower maintenance position in the lower region of the vertical masts 6 and 7. In this position, the compensating drums 19 are at a relatively large spacing from the respective guide drums 17 and 18 and there is a correspondingly large amount of film of the first film 2 and the second film 3 stored or taken up in the film-storing means 15 and 16. The invention proposes that when the film-feed head 4 is moved in the pull-down direction of the film or vertically downward, the spacing between the compensating drum 19 and the respective guide drums 17 and 18 is continuously changing and a successively increasing amount of film is taken up by the film-storing means 15 and 16. It is obvious that the film-storing means 15 and 16 are provided for the purposes of taking up film 2 or 3 when the film-feed head 4 is moved in the pull-down direction and to correspondingly let out film 2 or 3 when the film-feed head 4 is moved opposite to the pull-down direction. Thus, when the film-feed head 4 is moved opposite to the pull-down direction, film that is stored in the film-storing means 15 and 16 is let out as the compensating drums 19 move toward the guide drums 17 and 18.

Preferably and in this embodiment, a drive motor 21 is provided for the carriage 9 of the pull-down device 5. This drive motor 21 can be an electric motor. The drive motor 21 is mounted at the base of the apparatus and advantageously, as in the embodiment, is located at the base of one of the vertical masts 6 and 7. The drive motor 21 is connected to the pull-down carriage 9 of the pull-down device 5 by a coupling element in the form of a toothed belt 22 guided along the vertical mast 6. The drive motor 21 is further coupled thereto by an unillustrated shaft to another coupling element, here another toothed belt 22 that is guided along the second vertical mast 7. This allows the pull-down device 5 to be shifted along with the pull-down carriage 9 on the vertical masts 6 and 7 in the pull-down direction of the films 2 and 3 or opposite to the pull-down direction of the films 2 and 3 by only one drive motor 21. It is recommended, as seen in the embodiment, that the film-feed head 4 carry no drive of its own and that the film-feed head 4 can only be moved with the aid of the drive motor 21 of the pull-down device 5. It is preferred, as in the embodiment, for the film-feed head 4 to be supported on the pull-down device 5 or on the pull-down carriage 9 of the pull-down device 5 when it travels along the vertical masts 6 and 7. In this way, the system comprising the film-feed head 4 and the pull-down device 5 will move together in the pull-down direction of the film 2 or 3 our opposite thereto. The pull-down device 5 and the pull-down carriage 9 together support the film-feed head 4 when it moves vertically. When the film-feed head 4 is in an upper operating position (FIG. 1), the pull-down carriage 9 of the pull-down device 5 is first moved up against the film-feed head 4 from below in order to move the film-feed head 4 downward. In the process, a latch 23 of the film-feed head 4, described in more detail below, is released and the film-feed head 4 can then be moved downward to the lower maintenance position (FIG. 3) while supported by the pull-down device 5. Thanks to the mobility of the film-feed head 4 to a lower maintenance position and to the arrangement of the drive motor 21 at the base of the apparatus, these parts are optimally accessible for maintenance and repair work. The arrangement of the drive motor 21 at the base of the vertical mast 6 and the design of the film-feed head without a dedicated drive also provide ensure a relatively low weight of the film-feed head 4 and of the system comprising the film-feed head 4 and the pull-down device 5.

Figure 5:
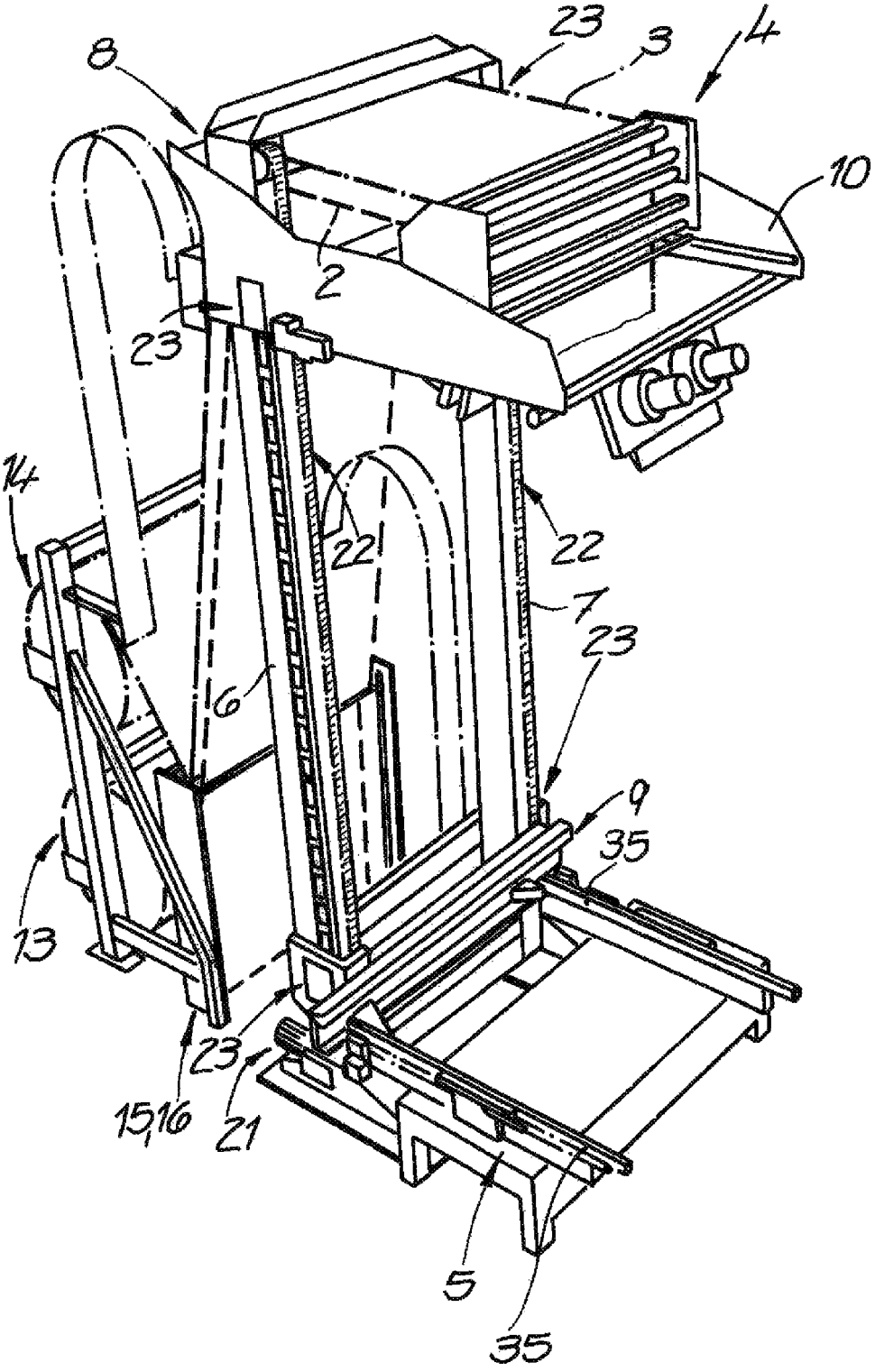
FIG. 5 is a perspective view of the apparatus according to the invention.
Figure 6:
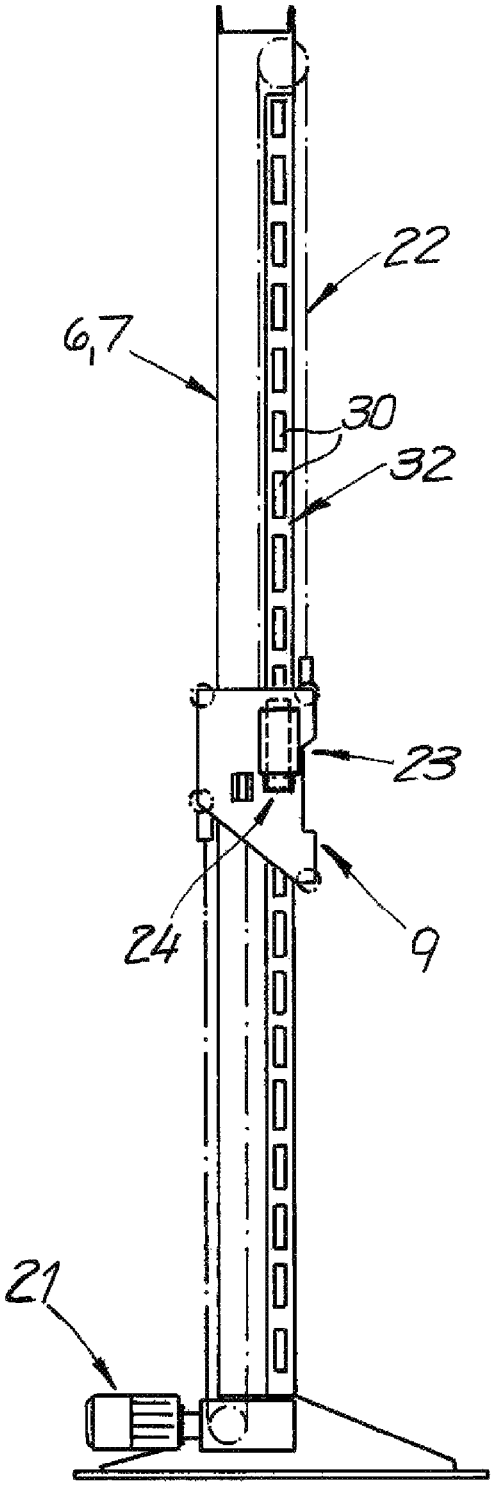
FIG. 6 is an enlarged view of a detail of FIG. 1 in a further position.
Figure 8:
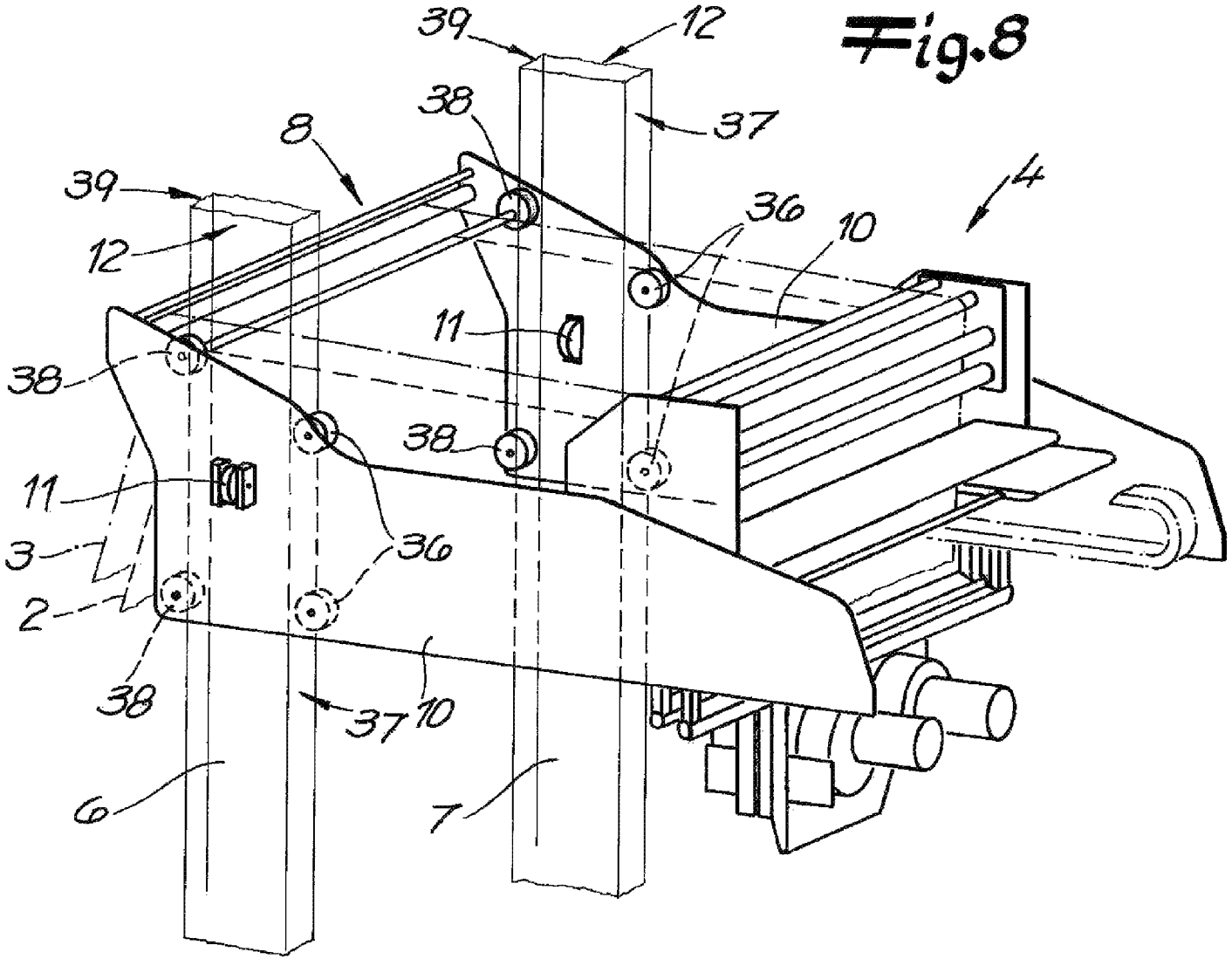
FIG. 8 is a perspective view of a film-feed head according to the invention.

FIGS. 5 and 8 in particular show that the film-feed head 4 comprises two side walls 10 parallel to one another and advantageously projecting at a right angle from the two vertical masts 6 and 7. Most of the remaining parts of the film-feed head 4 are contained between the two side walls 10. The ends of the two side walls 10 remote from the vertical masts 6 and 7 are connected together and the resultant structure forms the film-feed carriage 8. FIG. 8 shows that each side wall 10 rides on an outer face 12 of the respective vertical mast 6 and 7 via a support roller 11. Preferably in this embodiment, the support roller 11 is partially embedded in to the respective side wall 10. Each side wall 10 of the film-feed head 4 is further supported at a front face 37 of the respective vertical mast 6 and 7 by two support rollers 36 connected together and separated by a spacing that is preferably at least 30% of the spacing between the center of gravity of the film-feed head 4 and the plane defined by the front faces 37 of the vertical masts 6 and 7. Each side wall 10 of the film-feed head 4 is further supported by two support rollers 38 at a back face 39 of the respective vertical mast 6 and 7. The vertical spacing between these support rollers 38 is preferably at least 35% of the spacing between the center of gravity of the film-feed head 4 and the plane defined by the front faces of the vertical masts 6 and 7. One can see that the height of the side walls 10 near the vertical masts 6 and 7 and near the support rollers 11, 36, and 38 is larger or much larger than the height of the side walls 10 in the rest of the film-feed head 4. This creates a correspondingly large spacing between the support rollers 36 or between support rollers 38. One should also note that the parts of the film-feed head 4 are located exclusively outside the space between the two vertical masts 6 and 7. Only the films 2 or 3 pass between the two vertical masts 6 and 7 to the film-feed head 4.

Figure 7:
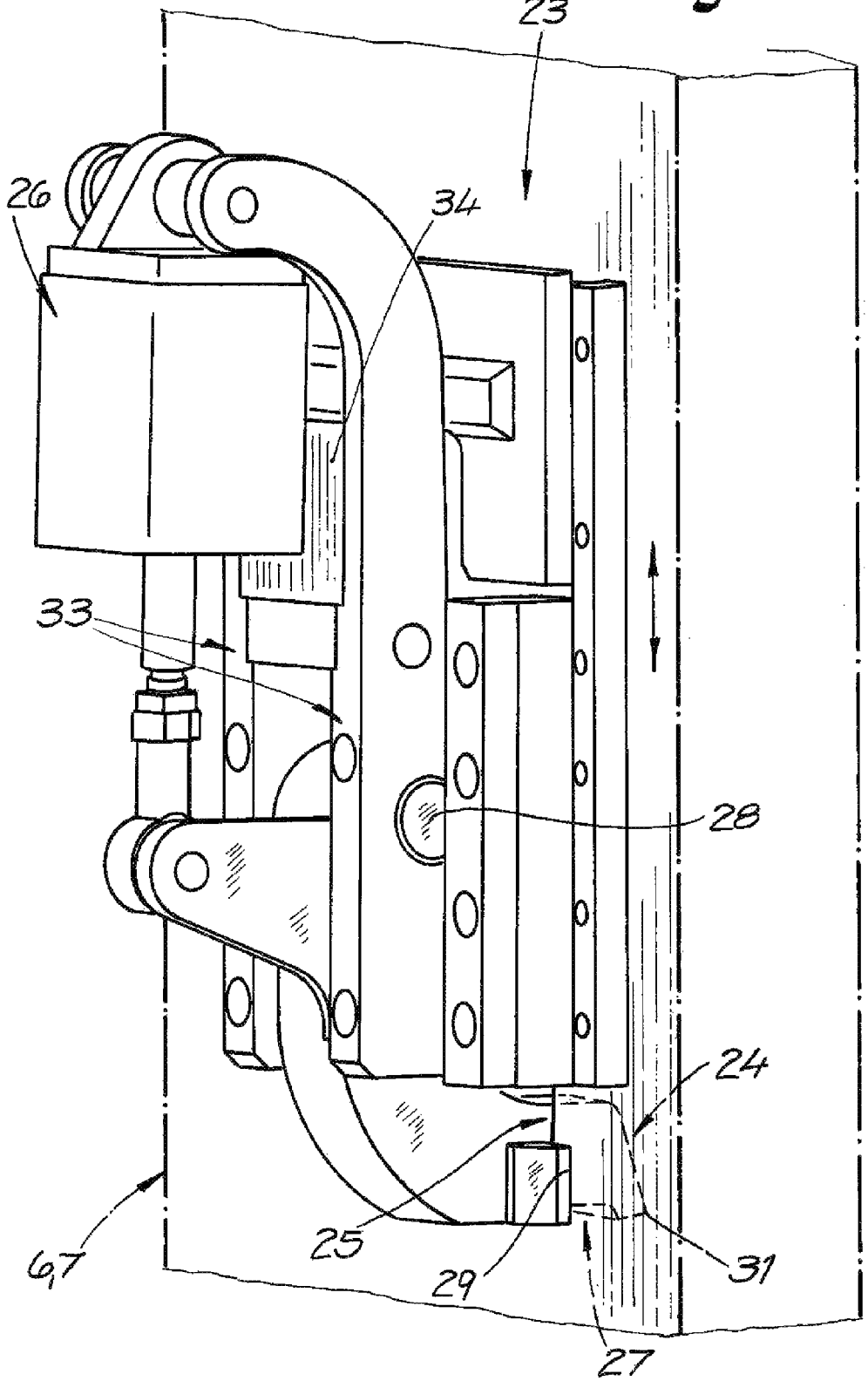
FIG. 7 is a perspective view of a latch according to the invention with a latch pawl.

It is advantageous to equip the film-feed head 4, as in this embodiment, with two safety latches 23 each having a pawl 24. The latches 23 are mounted on the opposite side walls 10 of the film-feed head 4 and are each associated with one of the vertical masts 6 and 7. Such a latch is shown in a perspective view in FIG. 7. In an upper operating position of the film-feed head 4 (FIG. 1), each of the two latch pawls 24 engages into a respective upper latch seat 25 that is provided in the upper region of each of the vertical masts 6 and 7. Each latch pawl 24 is biased into engagement with the respective latch seat 25 by a pneumatic cylinder 26. A cutout 27 in the latch pawl 24 makes it possible to engage the latch pawl 24 in the respective latch seat 25 to prevent an inadvertent pulling of the latch pawl 24 out of the respective latch seat 25. Also, the latch pawl 24 is held in its secured position as a result of the weight of the film-feed head 4 itself, since the weight thus pivots the latch pawls about their pivot axes 28 toward the respective latch seats 25 of the respective vertical masts 6 and 7. Over-rotation of the latch pawl 24 is advantageously prevented, as seen here, by an abutment 29 that bears against the respective vertical mast 6 and 7. As explained above, the film-feed head 4 is moveable vertically to a lower maintenance position (FIG. 3). In this lower maintenance position, the two latch pawls 24 of the film-feed head 4 engage into two respective unillustrated lower latch seats that are each formed in a respective one of the two vertical masts 6 and 7. The latch pawls 24 are engaged or made to move into these latch seats as described above in connection with the upper latch seats 25.

It is recommended as shown in the illustrated embodiment that the latches 23 of the film-feed head 4 are at the same time designed as antidrop devices for the film-feed head 4. In particular if the toothed belts 22 of the pull-down device 5 break, an unbraked fall of the film-feed head 4 could occur. This is prevented by the antidrop notches 30 distributed along the vertical height of each of the vertical masts 6 and 7 and interacting with the latch pawls 24. When the film-feed head 4 falls, the antidrop notches 30 along the vertical masts 6 and 7 catch the two latch pawls 24 and the latch pawls 24 can each be supported by their outer ends 31 in a respective one of the antidrop notches 30 so that free fall of the film-feed head 4 is braked almost immediately. The antidrop notches 30 do not absolutely have to have the same depth as the latch seats 25 described above and in particular do not have to be formed in the masts 6 and 7. It is advantageous, as in the embodiment, to weld an index strip 32 to each mast in which the antidrop notches 30 are formed.

It is preferable as shown in the illustrated embodiment, for the latch 23 or antidrop device to have a damping device for damping the impact resulting when the respective latch pawl 24 engages into an antidrop notch 30. To this end, the subsystem comprising the latch pawl 24, its pneumatic cylinder 26 and a support 33 is moveable limitedly vertically relative to the rest of the safety latch 23. This motion is damped by elastic elements, here rubber bumpers 34. The vertical motion of the subsystem comprising the latch pawl 24, its pneumatic cylinder 26 and the support 33 has been indicated in FIG. 7 by a corresponding double arrow.

Figure 9:
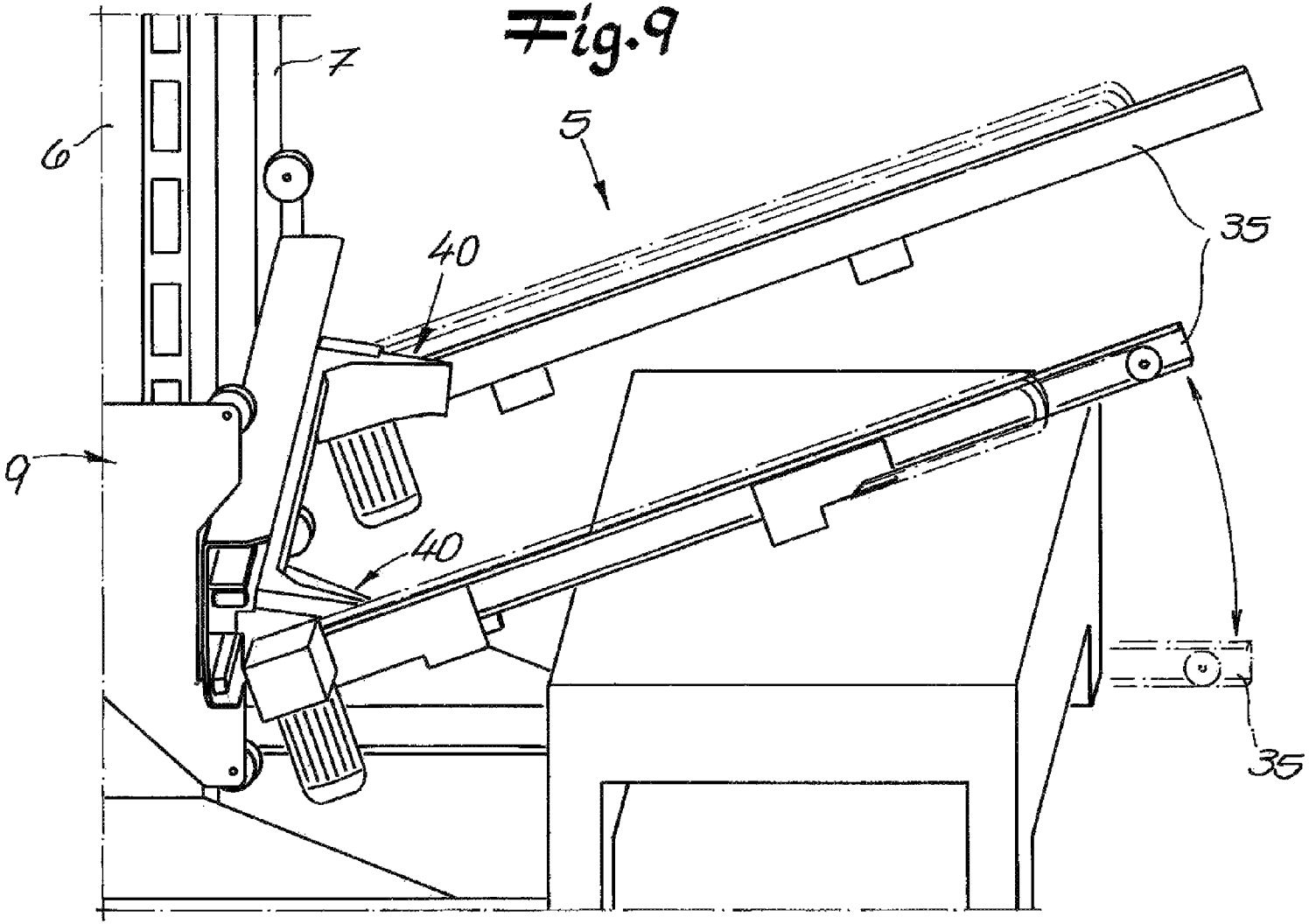
FIG. 9 is a perspective view of the pull-down device.

From FIG. 9, one can see that preferably the pull-down device 5 or arms 35 of the pull-down device 5 are able to pivot relative to the two vertical masts 6 and 7 about a horizontal axis. In the operating state of the apparatus or in particular when the film 2 or 3 is being pulled down, the pull-down device 5 extends perpendicular to the two vertical masts 6 and 7. When transporting the apparatus, the arms 35 can be pivoted to a position in which they extend upward parallel or substantially parallel to the two vertical masts 6 and 7. The ability of the arms 35 to pivot has also proven to be advantageous when the arms run into an obstacle during downward movement. In this case, the arms 35 are not damaged, but only pivot upward. The invention also proposes that the arms 35 only pivot when a minimum force acting on them is exceeded. Preferably in the illustrated embodiment, the arms 35 lie against support elements in a friction locked manner, and it is only possible for the arms 35 to pivot when the force acting on the arms 35 is larger than the retaining force due to the friction lock.

I claim:

1. An apparatus for wrapping a stationary stack of objects with a film tube, the apparatus comprising:

a film supply holding the film tube;

only two vertical masts adjacent the film supply and juxtaposed with the stack to be wrapped;

a pull-down device shiftable vertically along the two masts next to the stack, the pull-down device projecting horizontally from the masts and being pivotal relative to the masts about a horizontal axis closely juxtaposed with the masts between a down position extending horizontally from the masts and an up position projecting upward from the axis and lying generally against the masts;

a film-feed head above the pull-down device and shiftable vertically along the two masts, the film tube extending from the supply through the film-feed head to the pull-down device for pulling the film tube down around the stack; and film-storing means between the film supply and the film-feed head and including two vertically fixed and rotatable upper drums and a lower compensating drum vertically shiftable relative to the upper drums and movable vertically generally synchronously with the film-feed head for storing a length of the film tube for taking up the film tube by lowering the compensating drum when the film-feed head is moving downward and for letting out the film tube by raising the compensating drum when the film-feed head is moving upward.

2. The wrapping apparatus defined in claim 1, wherein the film-feed head has two side walls each projecting horizontally from and movable vertically along a respective one of the masts.

3. The wrapping apparatus defined in claim 2, wherein the masts each have a flat and vertical outer face turned away from the other mast, the side walls each having a side roller riding on the respective outer face.

4. The wrapping apparatus defined in claim 3, wherein each mast has a flat and vertical front face turned toward the stack, each of the side walls having a pair of vertically spaced upper and lower front rollers riding on the respective front face.

5. The wrapping apparatus defined in claim 4, wherein each mast has a flat and vertical back face turned away from the stack, each of the side walls having a pair of vertically spaced upper and lower back rollers riding on the respective back face.

6. The wrapping apparatus defined in claim 5, wherein a vertical spacing from the upper front roller to the lower back roller is at least 30% of a spacing between a center of mass of the film-feed head and a plane defined by the front faces of the vertical masts.

7. The wrapping apparatus defined in claim 5, wherein a vertical spacing from the upper back roller to the lower front roller is at least 30% of a spacing between a center of mass of the film-feed head and a plane defined by the front faces of the vertical masts.

8. The wrapping apparatus defined in claim 1, wherein substantially all of the elements of the film-feed head are located outside a space defined between the two masts.

9. The wrapping apparatus defined in claim 1, further comprising:

drive means connected to the pull-down device for moving the device downward to pull the film tube down over the stack and for moving the device upward to clear the stack.

10. The wrapping apparatus defined in claim 9, wherein the film-feed head is not directly connected to the drive means but instead is supported on the pull-down device to move vertically therewith under control of the drive means.

11. The wrapping apparatus defined in claim 10, further comprising:

latch means for securing the film-feed head in an upper position at upper ends of the masts so that the pull-down device can be moved vertically independently of the film-feed head.

12. The wrapping apparatus defined in claim 1, wherein there are two of the film-supply means each holding a respective film tube, the film-feed head being adapted to alternately feed one or the other of the film tubes, there also being two of the film-storing means for the respective film tubes.

13. The wrapping apparatus defined in claim 1, wherein the upper drums are vertically fixed and generally horizontally level with each other.

14. The wrapping apparatus defined in claim 13, wherein the film-storing means includes a vertical guide along which the lower compensating drum travels.

* * * * *